United States Patent [19]

Sakaoka

[11] Patent Number: 4,729,684

[45] Date of Patent: Mar. 8, 1988

[54] MECHANICAL PENCIL

[75] Inventor: Gouji Sakaoka, Tokyo, Japan

[73] Assignee: Micro Co., Ltd., Tokyo, Japan

[21] Appl. No.: 860,671

[22] Filed: May 7, 1986

[30] Foreign Application Priority Data

Jul. 18, 1985 [JP] Japan ..... 60-157023

[51] Int. Cl.[4] ..... B43K 21/22

[52] U.S. Cl. ..... 401/65; 401/67; 401/94

[58] Field of Search ..... 401/65, 67, 94

[56] References Cited

U.S. PATENT DOCUMENTS

| | | | |
|---|---|---|---|
| 2,158,991 | 5/1939 | Stenersen | 401/65 |
| 2,532,748 | 12/1950 | Votruba | 401/65 |
| 4,180,339 | 12/1979 | Katz | 401/65 |
| 4,452,544 | 6/1984 | Sumita | 401/65 |
| 4,459,057 | 7/1984 | Hashimoto et al. | 401/65 |
| 4,538,934 | 9/1985 | Brunner | 401/65 |

FOREIGN PATENT DOCUMENTS

| | | | |
|---|---|---|---|
| 2837586 | 3/1980 | Fed. Rep. of Germany | 401/65 |
| 380691 | 9/1932 | United Kingdom | 401/67 |
| 776226 | 6/1957 | United Kingdom | 401/67 |

*Primary Examiner*—Randolph A. Reese
*Assistant Examiner*—Anthony Knight
*Attorney, Agent, or Firm*—Bruce L. Adams; Van C. Wilks

[57] ABSTRACT

Mechanical pencil in which a chuck assembly for gripping a lead is formed with plural chuck elements mutually combined with each other. The chuck assembly has an internal longitudinal hole to insert a lead through and a lead gripping portion to grip the lead, while a lead guide tube is movably inserted within the lead inserting hole. The lead guide tube pushes on acting portions of the chuck to open the gripping portions of the chuck elements in the direction of parting them from each other when the lead guide tube is advanced, and the lead gripping portion opens to release the lead. The chuck is designed to enable releasing and gripping the lead securely so that it can be suitably used as a chuck mechanism for extending the lead automatically.

7 Claims, 5 Drawing Figures

MECHANICAL PENCIL

BACKGROUND OF THE INVENTION

1. Field of the Invention

This invention relates to a mechanical pencil, and in particular to an automatic mechanical pencil, in which a chuck for gripping a lead is formed with plural chuck elements mutually combined with each other.

2. Description of the Related Art

In a mechanical pencil, when writing is effected, the chuck will grip the lead and the tip of the chuck is so formed that it can be opened and closed to release the gripping of the lead when the same is extended or sent out. In a commonly used chuck, the tip of the cylindrical chuck body is divided by slits into two or three gripping pieces, each of them is outwardly bent, and the tips are urged in the direction of opening. And, in case of writing, by means of a tightening ring put on the outer periphery of the chuck, the gripping pieces are tightened, and when the lead is extended or sent out, the tightening ring is shifted to release the tightening, and by the elastic restorable force of the bent gripping pieces, these pieces are expanded to open the tip of the chuck.

As mentioned above, usual chucks are so formed that the gripping pieces are expanded by the elastic action of metallic material; however, in case a chuck of similar construction normally made of metallic material is formed with plastic material, the forming is difficult and cannot be simply manufactured. It was proposed that plural chuck elements be provided and these be complementarily combined to form a chuck; however, to open the tip of the chuck under the combined state, there are many chucks formed by bending their tip of chuck elements outwardly.

On the other hand, in a pencil of a type which automatically sends out the lead, the chuck should be formed so as to release the gripping of the lead when the lead is sent out forwardly and to grip the lead when the lead is pushed backwardly. The chuck for assuring such a function is complicated in formation and cannot be manufactured economically.

SUMMARY OF THE INVENTION

The object of this invention is to obtain a mechanical pencil, in which plural chuck elements themselves, forming the chuck by complementarily combining the elements, are not formed by bending the elements so as to expand elastically, but the tip of the chuck is made to open automatically when the lead is extended.

According to this invention, a mechanical pencil is provided, in which plural chuck elements are complementarily combined to form a chuck, within which a lead guide tube is movably inserted so as to expansively open the chuck by axial shifting of the lead guide tube.

Other objects and features of the invention will become apparent from the following detailed description referring to the accompanying drawings.

DESCRIPTION OF THE PREFERRED EMBODIMENTS

Figure 1:
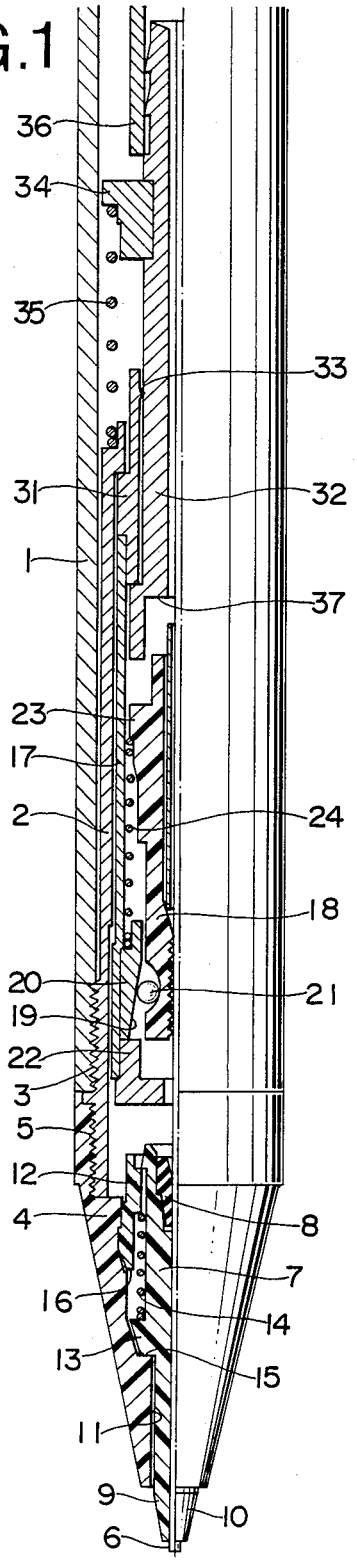
FIG. 1 is a front view of a mechanical pencil according to this invention, showing a half section of the pencil along the axial direction thereof.

This invention may be applied to mechanical pencils of various construction, however, some examples applied to mechanical pencils of the type sending out the lead automatically will be explained in the following.

In the drawings, the tip of a main body (1) is screwed (3) with a holder (2), to which a tip piece (4) is screw-fitted (5). Within the tip piece, an operation member (7) is provided, which elastically holds a lead (6) with frictional action and is urged by spring (14) to project its tip pipe (9) from the writing end of the main body as well as being shiftably or slidably in an axial direction. Within the holder (2), a shift control means more particularly described hereinafter is provided to allow forward movement of the lead and to prevent its backward movement.

The operation member (7) is fixed with an elastic ring (8) made of elastic materials, such as rubber, synthetic resins, etc., on the rear portion and a tip pipe (9) formed with the plastic material having a small coefficient of friction is provided on the tip thereof. As the plastic material, polyacetal, polyamide, fluororesin and other thermoplastic material having a low coefficient of friction may be used. In case of polyaretal and polyamide, the coefficient of friction is about 0.15–0.2, which are considerably smaller than that of the case of stainless pipe (about 0.37–0.4) which has been used usually as the tip pipe.

In the drawings, the operation member (7) is integrally molded with the plastic material including the tip pipe 9, however, the tip pipe (9) may be made separately and the two combined together. The tip pipe is preferably provided with a tapered face (10) and is slidably inserted in a bore (11) made on the mouth piece (4). The rear portion of the operation member (7) is inserted in a stopper (12) fixed to the interior of the tip piece, and by means of a spring (14) provided between a flange (13) made on an intermediate portion of the operation member and the stopper (12), the operation member is urged so that the flange (13) will advance until it abuts against a shoulder (15) of the tip piece. When the top of the tip pipe (9) touches a paper face on a supporting surface and is pushed backward in case of writing, the operation member (7) will move back along the axial direction until the flange (13) abuts against a front end (16) of the stopper (12). When the force pressing the top of the tip pipe backward is removed, the operation member (7) will return to the advanced position by means of the spring (14), and accompanying therewith, the lead held by the elastic ring (8) will advance. It is preferable to make the mouth piece (4) with plastic materials such as polyacetal, and polyamide having the same effect as on the tip pipe.

The shift control means may be formed in various ways. In the drawing, it is formed as follows:

Within the holder (2), a slide sleeve (17) is inserted which is shiftable in the axial direction, and within the slide sleeve, a chuck (18) is provided which allows forward movement of the lead and prevents its backward movement. The chuck is formed by oppositely combining mutual chuck elements (18), on the front periphery of which a tightening ring (20) is provided, which fits in the slide sleeve (17) and which has a tapered surface (19) on its inner face, and balls (21) are interposed between the ring and the chuck elements. The front end of the ring (20) abuts a chuck stopper (22) fit onto the slide sleeve (17). Between the rear end of the ring 20 and a flange (23) provided on the rear portion of the chuck element (18), a chuck spring (24) is provided. By means of the chuck spring, the chuck element is embraced at its rear portion. The chuck elements (18) are comprised of two half portions so as to form a cylindrical body having a lead inserting hole (25) on the inner face and a lead gripping portion (26) on the front inner face, when the half portions are complementarily combined. However, the chuck may be formed with more than two portions.

Figure 2:
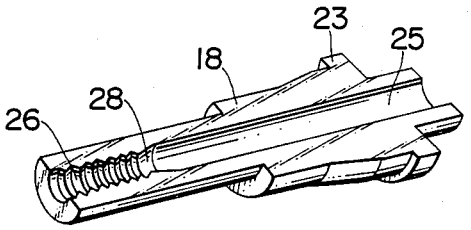
FIG. 2 is a perspective view of the chuck element according to this invention.
Figure 3:
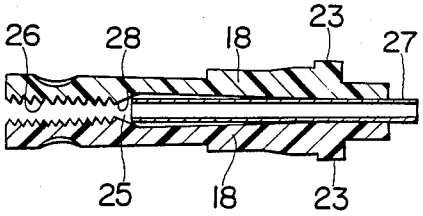
FIG. 3 is a cross sectional view of the chuck according to this invention under the expansively opened state of the tip of the chuck (by a lead guide tube).
Figure 4:
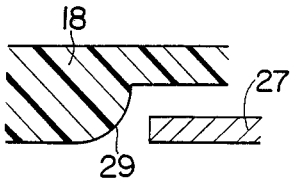
FIG. 4 and FIG. 5 are respective enlarged sectional views of portions of other embodiments of this invention, showing the relation between the inner wall of the chuck element and the tip of the lead guide tube.
Figure 5:
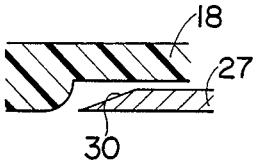

In the lead inserting hole of the chuck, a lead guide tube (27) is shiftably inserted. The rear end of the lead guide tube projects from the rear portion of the chuck and the front end thereof faces an acting portion (28) provided on the rear portion of the lead gripping portion (26). The acting portion and the tip of the lead guide tube (27) are provided with suitable guide faces so that the chuck will open in the direction of mutual separation of the chuck elements when they would strike against each other. In the guide faces shown in FIGS. 1–3, the acting portion (28) is made as a slope. In FIG. 4, an example is shown, wherein the acting portion (29) is made as an ovolo. As shown in FIG. 5, the tip of the lead guide tube may be made as a slope (30).

According to the above mentioned formation, at the time of the lead extending operation, on the half way of an advance of a knock (32), the knock and the lead guide tube will abut, and by the advance of the knock and the lead guide tube, the tip of the lead guide tube pushes the acting portion 28 of the chuck, thus outwardly opening the chuck elements to pass the lead freely. The advance of the knock will finish where the chuck abuts the chuck stopper (22) under the opened state. When the knock pressure is released, the chuck will move back as it is under the opened state. When the chuck is released from the push of the knock, the tightening force will act in a central direction by the chuck spring (24) and the tightening ring (20). By means of this tightening force and the guide of the acting portion (28), the lead guide tube (27) is pushed backward and shifted, the tip of chuck elements (18) is closed and the lead (6) is securely held by the lead gripping portion.

On the rear end of the slide sleeve (17), a sleeve cap (31) is fitted, the knock (32) is inserted in the sleeve cap (31). A small circular projection (33) is provided on the inner surface of the sleeve cap so that the knock still can move under the pressing contact of the circular projection. On the rear periphery of the knook (32), a spring seat (34) is provided, and a knock spring (35) is provided between the spring seat (34) and the rear end of the holder (2). On the rear end of the knock, a lead reservoir (36) is fitted.

The lead (6) stored in the lead reservoir (36) is stopped against the lead gripping portion (28) of the chuck under a stand-up situation of the main body (1). In this position, when the rear end of the lead reservoir is pushed, the slide sleeve (17) is advanced with the knock, because the knock is held by the circular projection (33) of the sleeve cap. After the chuck stopper (22) has abutted against the rear end of the operation member (7), the knock (32) will further advance against the pressing force of the small circular projection (33). When an inner shoulder (37) of the knock (32) pushes the rear end of the lead guide tube (27) to advance the chuck, the lead gripping portion of the chuck is pushed open by the lead guide tube, as mentioned above. Thus the lead (6) is advanced by its dead weight to a position where it hits against the elastic ring (8) of the operation member (7). When the knock pressure is released, the slide sleeve will return to the state shown in FIG. 1 by means of the knock spring (35) and the chuck spring (24), and the lead is gripped by the lead gripping portion (28). When the rear end of the lead reservoir is pushed again, then the slide sleeve will advance to a position entering into the interior of the elastic ring (8), because the lead is gripped by the chuck. Thereafter, by repeating this operation, the lead will project from the top of the tip pipe (9) to enable writing.

At the time of writing, the top of the tip pipe (9) together with the lead will contact on the paper face and the operation member (7) will move back. When the writing is stopped and the tip is lifted from the paper face, the operation member (7) holding a lead will advance by the spring (14), at this time the chuck will advance together with the lead, and the chuck element is released from the tightening force by means of balls (21) and taper (19), thereby the gripping of the lead is released, so that the lead together with the operation member (7) will be automatically extended to an advanced position. The above mentioned example is shown as an application to a ball chuck mechanism; however, it may be applied to a usual collect chuck mechanism, and also be applicable to the known mechanical pencils.

Since the present invention is formed as mentioned above, its formation becomes simple and it can be made economically, as well as the lead is securely gripped and never slips off.

It is to be understood that the present invention is not limited to the above mentioned embodiments thereof, but may be otherwise variously modified within the scope of the following claims.

What is claimed is:

1. In a lead pencil: a chuck assembly for releasably gripping and advancing a lead during use of the pencil, the chuck assembly comprising a plurality of separate, complementary chuck elements positioned to define therebetween a longitudinal bore, the chuck elements being separately displaceable toward and away from one another to define respectively lead-gripping and lead-releasing positions; a lead guide tube slidably disposed in the longitudinal bore, the lead guide tube having a forward end abuttably engageable with acting portions of said chuck elements so that forward displacement of the lead guide tube sequentially effects forward displacement of the chuck assembly accompanied by advancement of the lead followed by displacement of said chuck elements to the lead-releasing position to thereby release the lead, a rearward end of said lead guide tube projecting rearwardly of the chuck elements, and the lead guide tube extending through a major lengthwise extent of the longitudinal bore and slidably receiving therein the lead for guiding the lead; means for normally urging the chuck elements to the lead-gripping position; and means for effecting manual forward displacement of said lead guide tube to sequentially effect forward displacement of the chuck assembly accompanied by advancement of the lead followed by separate displacement of the chuck elements to the lead releasing position.

2. A lead pencil according to claim 1; wherein the chuck element acting portions have a given shape effective to coact with the forward end of the lead guide tube such that forward movement of the lead guide tube effects radially outward displacement of the chuck elements to their lead-releasing position.

3. A lead pencil according to claim 1, wherein said chuck elements each have a toothed lead gripping portion forward of said acting portion.

4. A lead pencil according to claim 2; wherein said given shape comprises a sloped surface.

5. A lead pencil according to claim 2; wherein said given shape comprises an ovolo.

6. A lead pencil according to claim 5; wherein the forward end of said lead guide tube comprises a sloped surface.

7. In a lead pencil having a main body with a front end and a back end and a tip piece affixed by screw threads at the front end of the main body, said pencil comprising:

an operation member having a tip piece at a front portion and an elastic ring frictionally holding a lead at a rear portion, said lead shiftably mounted in the tip piece and adapted to be urged forwardly;

a holder mounted in the main body;

a slide sleeve inserted in the holder, said slide sleeve shiftable between a rear end of the holder and the rear end of the operation member;

a chuck shiftably provided in the slide sleeve, said chuck comprising plural chuck elements mutually combined with each other to grip the lead;

a lead guide tube shiftably inserted in the chuck and mounted to push open the chuck, and wherein a front end of the lead guide tube is disposed in the chuck and a rear end of the lead guide tube projects backward beyond the chuck elements;

a chuck spring urging the chuck rearwardly;

plural ball means for urging said chuck into tightening engagement with said lead;

a chuck stopper provided in front of said chuck to abut said chuck to stop advancement thereof;

a sleeve cap provided at the rear end of the slide sleeve;

a shiftable knock mounted within the sleeve cap and having a front tip disposed opposite the rear end of the lead guide tube so as to press against the lead guide tube responsive to advancement of the knock;

a circular projection provided on the sleeve cap in press fit contact with the side of the knock so that the slide sleeve and the knock move in unison when the knock is advanced until the front end of the slide sleeve abuts on the rear end of the operation member;

a spring seat on the knock; and a knock spring disposed between the rear end of the holder and the spring seat, and which urges the knock rearwardly.

* * * * *